US009945165B2

(12) United States Patent
Choi

(10) Patent No.: US 9,945,165 B2
(45) Date of Patent: Apr. 17, 2018

(54) COMPATIBLE DOOR HINGE FOR VEHICLES

(71) Applicant: Hyundai Motor Company, Seoul (KR)

(72) Inventor: Seung-Il Choi, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/961,515

(22) Filed: Dec. 7, 2015

(65) Prior Publication Data

US 2017/0058585 A1 Mar. 2, 2017

(30) Foreign Application Priority Data

Aug. 24, 2015 (KR) ..... 10-2015-0118893

(51) Int. Cl.

| | |
|---|---|
| ***E05D 5/06*** | (2006.01) |
| ***E05D 5/14*** | (2006.01) |
| ***E05D 5/02*** | (2006.01) |
| ***E05D 7/06*** | (2006.01) |
| *E05D 3/02* | (2006.01) |

(52) U.S. Cl.

CPC ..... *E05D 5/062* (2013.01); *E05D 5/0207* (2013.01); *E05D 5/14* (2013.01); *E05D 7/06* (2013.01); *E05D 3/02* (2013.01); *Y10T 16/554* (2015.01)

(58) Field of Classification Search

CPC .. E05D 5/062; E05D 3/02; E05D 5/14; E05D 7/04; E05D 7/121; E05D 5/0207; E05D 7/06; E05C 17/203; E05Y 2900/531; Y10T 16/554; Y10T 16/558; Y10T 16/61; Y10T 16/5323

USPC ..... 16/382, 82, 387, 239; 296/146.11

See application file for complete search history.

(56) References Cited

U.S. PATENT DOCUMENTS

| | | | | |
|---|---|---|---|---|
| 4,720,895 | A * | 1/1988 | Peebles | E05D 7/121 16/248 |
| 4,807,331 | A * | 2/1989 | Calucci | E05D 7/1005 16/262 |
| 5,444,894 | A * | 8/1995 | Heiler | E05D 7/121 16/257 |
| 6,332,243 | B1 | 12/2001 | Kim | |
| 7,430,785 | B2 * | 10/2008 | Brown | E05D 11/1042 16/286 |

(Continued)

FOREIGN PATENT DOCUMENTS

| | | |
|---|---|---|
| JP | 06-027553 | 2/2006 |
| JP | 2013-244788 A | 12/2013 |

(Continued)

*Primary Examiner* — William Miller

(74) *Attorney, Agent, or Firm* — Mintz Levin Cohn Ferris Glovsky and Popeo, P.C.; Peter F. Corless

(57) ABSTRACT

A compatible door hinge for vehicles includes a lower plate which has a pin hole and a hinge hole in which a hinge pin and a bushing pin are respectively disposed, an upper plate which is coupled to the lower plate by the hinge pin and can be changed in position relative to the lower plate, and a body plate with which the lower plate and the upper plate are integrated by the bushing pin passing through them. A minimum required setting distance between the door hinge and an upper or lower door skin of a vehicle door can be maintained without changing the design shape of the door skin. Particularly, a door opening trajectory can be formed closer to the door skin and reduced in radius, such that a rotation gap is ensured.

13 Claims, 15 Drawing Sheets

CROSS SECTION D-D

(56) References Cited

U.S. PATENT DOCUMENTS

| | | | | |
|---|---|---|---|---|
| 7,585,013 | B2 * | 9/2009 | Brown | E05D 11/1042 16/86 C |
| 7,748,768 | B2 * | 7/2010 | Hofacker | E05D 5/121 16/374 |
| 2015/0314673 | A1 * | 11/2015 | Watterworth | B60J 5/0468 296/146.11 |
| 2015/0368945 | A1 * | 12/2015 | Sasa | E05D 3/02 16/377 |

FOREIGN PATENT DOCUMENTS

| | | |
|---|---|---|
| KR | 1000200287 | 3/1999 |
| KR | 10-0705131 B1 | 4/2007 |
| KR | 10-1415378 | 6/2014 |

* cited by examiner

CROSS SECTION A-A

CROSS SECTION B-B

CROSS SECTION A-A

CROSS SECTION B-B

CROSS SECTION C-C

CROSS SECTION D-D

CROSS SECTION C-C

CROSS SECTION D-D

COMPATIBLE DOOR HINGE FOR VEHICLES

CROSS-REFERENCE TO RELATED APPLICATION

This application claims under 35 U.S.C. § 119(a) the benefit of Korean Patent Application No. 10-2015-0118893, filed on Aug. 24, 2015, the entire contents of which are incorporated by reference herein.

BACKGROUND (a) Technical Field

The present invention relates to a door hinge; and, more particularly, to a compatible door hinge for vehicles which imposes no restriction on the degree of freedom in design of a door skin.

(b) Description of the Related Art

Generally, door checkers used for vehicle doors enable a vehicle door to open in stages, and door hinges support the weight of the vehicle door and act as the center of rotation when the vehicle door opens or closes.

The door hinges typically have a simple structure with a small number of parts and are an example of representative common use parts in that they can be applied to any vehicle door regardless of the kinds of doors. For instance, a door hinge includes a side plate which is fixed to a door panel, a body plate which is fixed to a vehicle body panel, and a hinge pin which integrates the side plate with the body plate and acts as the center of rotation of the door.

Particularly, the structure of the side plate of the door hinge has effects both on ensuring a rotation gap for a door opening trajectory and on the design of the door skin. Therefore, the side plate of the door hinge is important with regard to the compatibility of the door hinge.

For this, the side plate of the door hinge is designed in a form in which any one of upper and lower portions of the side plate based on a hinge shaft is bent inward so as to minimize effects on the design of the door skin in which upper and lower portions thereof are reduced in width compared to a medial portion thereof having a relatively large width.

However, the side plate of the door hinge has a single body structure with the hinge shaft as the center thereof. Thus, two factors, i.e., an increase of the degree of freedom in design of the door skin and the compatibility of the door hinge may conflict with each other.

If the degree of freedom in design of the door skin is increased, a modification in design and shape of the side plate of the door hinge may be required, in other words, the compatibility of the door hinge is reduced. On the other hand, to ensure the compatibility of the door hinge, the degree of freedom in design of the door skin must be markedly reduced because of a limited shape of the side plate of the door hinge and a limited position adjustment distance within which the installation position of the door hinge can be changed.

SUMMARY

An embodiment of the present invention is directed to a compatible door hinge for vehicles in which a side plate to be fixed to a vehicle door is formed of separable side plates having a pin assembly type structure, so that a minimum required setting distance between the door hinge and an upper or lower door skin of the vehicle door can be easily maintained without changing the design shape of the door skin and, particularly, a door opening trajectory can be formed closer to the door skin and reduced in radius, whereby a rotation gap can be more easily ensured.

In accordance with an embodiment of the present invention, there is provided a compatible door hinge for vehicles, including: a lower plate having a pin hole in which a hinge pin is disposed, and a hinge hole in which a bushing pin is disposed; an upper plate having a pin hole in which the hinge pin is disposed so that the upper plate is coupled to the lower plate by the hinge pin, and a hinge hole in which the bushing pin is disposed such that the upper plate can be changed in position relative to the lower plate; a body plate having an assembly width T and allowing coupling portions of the lower and upper plates to be inserted thereinto, the coupling portions being coupled to each other by the hinge pin and having an insert width t, the body plate having hinge holes in which the bushing pin is disposed such that the lower plate and the upper plate are integrated with the body plate.

A minimum required setting distance between the upper plate and an upper door skin or a lower door skin of a vehicle door may be maintained by the change in position of the upper plate. The coupling portions coupled to each other by the hinge pin may have an insert coupling structure. The insert coupling structure may be embodied by a depression formed in the lower plate and a protrusion provided on the upper plate.

The lower plate may include: a bent body in which the pin hole and the hinge hole are formed, each of the pin hole and the hinge hole having a circular shape; a position fixing body perpendicularly bent from the bent body, with a bolt hole formed in the position fixing body; and a female boss extending from the bent body and forming the coupling portion to be coupled with the upper plate, the coupling portion of the female boss having the pin hole and an insert slot through which the upper plate is coupled to the coupling portion of the female boss. The upper plate may include: a bent body in which the pin hole and the hinge hole are formed, each of the pin hole and the hinge hole having a circular shape; an inclined position-fixing body perpendicularly bent from the bent body, with a bolt hole formed in the inclined position-fixing body; and a male boss extending from the bent body and having the pin hole therein, the male boss forming the coupling portion to be inserted into the insert slot and coupled with the lower plate.

The lower plate may include: a bent body in which the pin hole and the hinge hole are formed, the pin hole being an elongated hole while the hinge hole has a circular shape; a position fixing body perpendicularly bent from the bent body, with a bolt hole formed in the position fixing body; and a female boss extending from the bent body and forming the coupling portion to be coupled with the upper plate, the coupling portion of the female boss having the pin hole and an insert slot through which the upper plate is coupled to the coupling portion of the female boss. The upper plate may include: a bent body in which the pin hole and the hinge hole are formed, each of the pin hole and the hinge hole being an elongated hole; an inclined position-fixing body perpendicularly bent from the bent body, with a bolt hole formed in the inclined position-fixing body; and a male boss extending from the bent body and having the pin hole therein, the male boss forming the coupling portion to be inserted into the insert slot and coupled with the lower plate. The elongated holes may allow the change in relative position of the upper plate to be performed in a linear section.

The lower plate may include: a bent body in which the pin hole and the hinge hole are formed, the pin hole being an elongated hole while the hinge hole has a circular shape; a position fixing body perpendicularly bent from the bent body, with a bolt hole formed in the position fixing body; and a female boss extending from the bent body and forming the coupling portion to be coupled with the upper plate, the coupling portion of the female boss having the pin hole and an insert slot through which the upper plate is coupled to the coupling portion of the female boss. The upper plate may include: a bent body in which the pin hole and the hinge hole are formed, the pin hole being an elongated hole while the hinge hole is an inclined elongated hole; a position-fixing body perpendicularly bent from the bent body, with a bolt hole formed in the position-fixing body; and a male boss extending from the bent body and having the pin hole therein, the male boss forming the coupling portion to be inserted into the insert slot and coupled with the lower plate, wherein the assembly width T of the body plate may be an assembly width T-1 increased by a movement clearance W. The elongated hole may allow the change in relative position of the upper plate to be embodied by angular motion. Each of the pin hole of the lower plate and the pin hole of the upper plate may be an inclined elongated hole.

The assembly width T of the body plate may be greater than the insert width t. The body plate may include: a bent body which is bent at a right angle; and an insert opening formed in a portion of the bent body and receiving the coupling portions coupled to each other by the hinge pin, wherein the insert opening provides a space for allowing the change in position of the upper plate relative to the lower plate. The bent body may include upper and lower side extension parts extending along an entire length of the bent body and perpendicularly bent from the bent body, the upper and lower side extension parts forming the assembly width T therebetween.

DESCRIPTION OF SPECIFIC EMBODIMENTS

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present invention may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Figure 1:
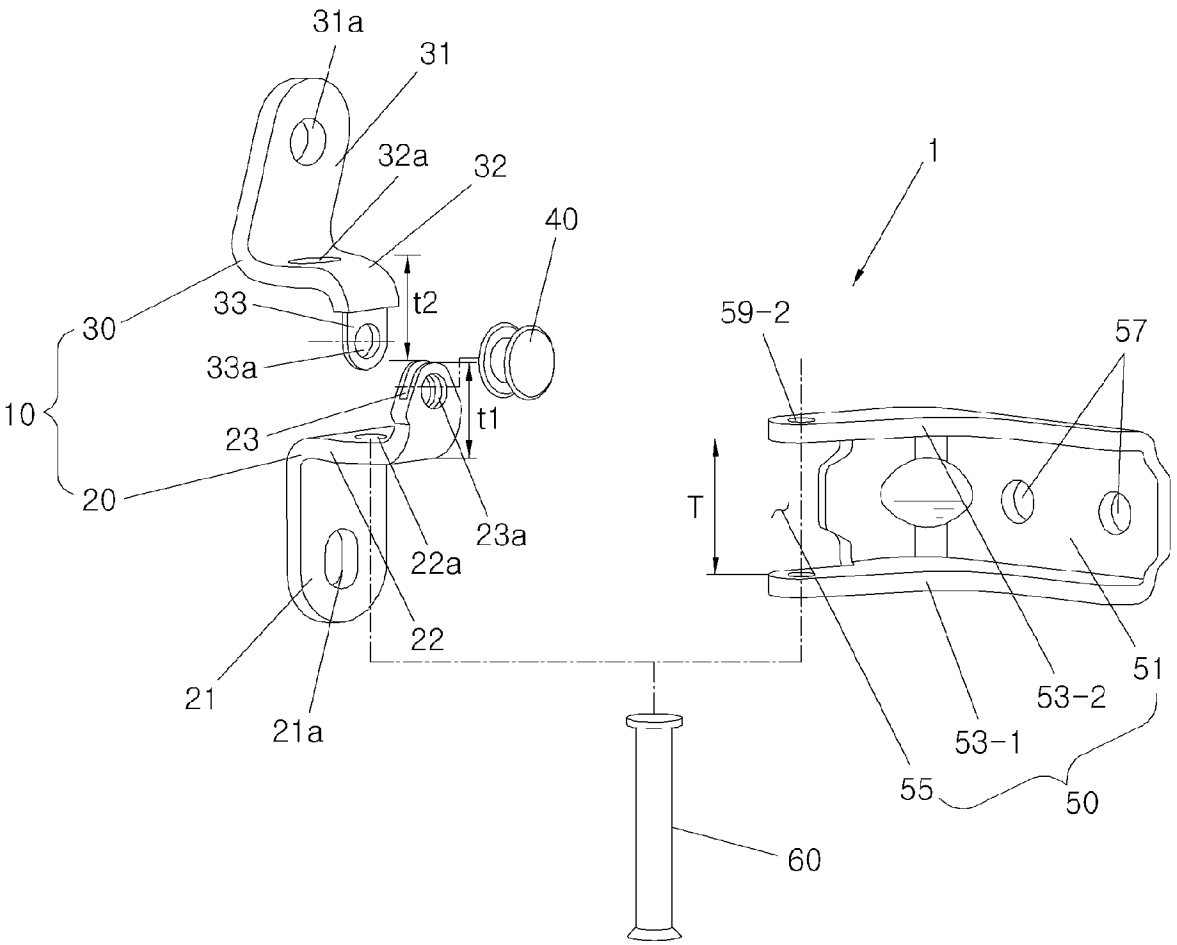
FIG. 1 is an exploded perspective view showing the configuration of a compatible door hinge for vehicles according to the present invention.

FIG. 1 is an exploded perspective view showing the configuration of a compatible door hinge for vehicles according to the present invention.

As shown in FIG. 1, the compatible door hinge 1 includes a separable side plate unit 20, 30 and 40, a body plate 50, and a bushing pin 60.

Figure 7:
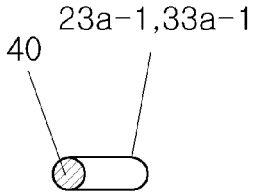

In detail, the separable side plate unit 20, 30 and 40 includes a lower plate 20, an upper plate 30 and a hinge pin 40. The hinge pin 40 integrates the lower plate 20 and the upper plate 30 with each other and functions as a center of rotation for movement of the upper plate 30. As shown in FIG. 7, the separable side plate unit 20, 30 and 40 is fixed to a portion of a door.

For example, the lower plate 20 includes a position fixing body 21, a bent body 22 which is perpendicularly bent from the position fixing body 21, and a female boss 23 which is perpendicularly bent from the bent body 22 in a direction parallel to the position fixing body 21. The position fixing body 21 has a bolt hole 21*a* allowing a screw or bolt to pass therethrough so that the position fixing body 21 can be fixed to a target component to be mounted with the lower plate 20. The bent body 22 has in a medial portion thereof a hinge hole 22*a* allowing the bushing pin 60 to pass therethrough so that the lower plate 20 can be integrated with the body plate 50. The female boss 23 has a depression structure using an insert slot into which a portion of the upper plate 30 can be inserted. A pin hole 23*a* is formed in the female boss 23, and the hinge pin 40 can be disposed in the female boss 23 through the pin hole 23*a*.

The upper plate 30 includes an inclined position-fixing body 31, a bent body 32 which is perpendicularly bent from the inclined position-fixing body 31, and a male boss 33 which is perpendicularly bent from the bent body 32 in a direction parallel to the inclined position-fixing body 31. The inclined position-fixing body 31 has a bolt hole 31*a* allowing a screw or bolt to pass therethrough so that the inclined position-fixing body 31 can be fixed to the target component to be mounted with the upper plate 30. Particularly, the inclined position-fixing body 31 has an entire shape in which it is inclined to one side relative to the bent body 32 so that the position at which the inclined position-fixing body 31 is fixed to the target component is formed at a more rear side than that of the lower plate 20. The bent body 32 has in a medial portion thereof a hinge hole 32*a* allowing the bushing pin 60 to pass therethrough so that the upper plate 30 can be integrated with the body plate 50. The male boss 33 has a protrusion structure which can be inserted into the insert slot of the female boss 23. A pin hole 33*a* is formed in the male boss 33 so that the hinge pin 40 can be disposed in the male boss 33 through the pin hole 33*a*. Therefore, the coupling between the female boss 23 and the male boss 33 is embodied by an insert coupling method using the depression-protrusion structure.

The separable side plate unit 20, 30 and 40 is assembled by temporarily coupling the lower plate 20 and the upper plate 30 to each other using the depression-protrusion structure and by inserting the hinge pin 40 into the pin holes 23*a* and 33*a* of the temporarily coupled upper and lower plates 20 and 30. Here, the hinge pin 40 has a diameter allowing it to be inserted into the pin holes 23*a* and 33*a*. When opposite ends of the hinge pin 40 after having been inserted into the pin holes 23*a* and 33*a* are pressed, the lower plate 20 and the upper plate 30 can be integrated with each other without being separated from each other. As a result, a horizontal length t1 of the female boss 23 of the lower plate 20 and a horizontal length 2*t* of the upper plate 30 overlap each other by a predetermined length, thus forming an insert width t (referring to FIGS. 2 and 4) of the separable side plate unit 20, 30 and 40. In the present embodiment, the insert width t is less than an assembly width T of the body plate 50. In particular, the sizes of the pin holes 23*a* and 33*a* of the lower and upper plates 20 and 30 and the size of the hinge hole 32*a* of the upper plate 30 are set to appropriate sizes to maintain a minimum required setting distance between the door hinge and a target door skin. In the present embodiment, the minimum required setting distance may be within about 12 mm.

The body plate 50 includes a bent body 51 which is perpendicularly bent to have the assembly width T, and upper and lower side extension parts 53-1 and 53-2 which are perpendicularly bent from the bent body 51 along the whole length of the bent body 51. The body plate 50 is fixed to a portion of a vehicle body panel (referring to FIG. 15). In the present embodiment, one side section of the bent body 51 forms an insert opening 55 which is formed for coupling between the body plate 50 and the separable side plate unit 20, 30 and 40, and the other side section of the bent body 51 has a bolt hole 57 which is used for fixing the body plate 50 to the vehicle body panel. Hinge holes 59-1 and 59-2 are respectively formed in portions of the upper and lower side extension parts 53-1 and 53-2 that are adjacent to the insert opening 55. The bushing pin 60 is disposed in the hinge holes 59-1 and 59-2.

In detail, the bushing pin 60 has a diameter that allows the bushing pin 60 to be inserted into the hinge holes 59-1 and 59-2. After having been inserted into the hinge holes 59-1 and 59-2, the bushing pin 60 is deformed on the opposite ends thereof so that the bushing pin 60 can be integrated with the body plate 50 without being removed therefrom.

To assemble the compatible door hinge 1, the hinge pin 40 is inserted into the pin holes 23*a* and 33*a* to integrate the lower plate 20 and the upper plate 30 with each other, thus forming the integrated separable side plate unit 20, 30 and 40. Thereafter, the separable side plate unit 20, 30 and 40 is inserted into the insert opening 55 of the body plate 50. In this state, the bushing pin 60 is inserted into the hinge holes 59-1 and 59-2, thus integrally assembling the separable side plate unit 20, 30 and 40 with the body plate 50. The separable side plate unit 20, 30 and 40 can rotate within a predetermined angular range using the bushing pin 60 as the center of rotation, thus making it possible to embody the operation of opening or closing the vehicle door. Particularly, even after having assembled with the lower plate 20, the upper plate 30 can be rotated around the hinge pin 40 within a predetermined angular range. Thereby, the compatible door hinge 1 can be easily applied to the door skin regardless of the pre-designed or preset shape of the door skin.

FIGS. 2-7 illustrate the detailed configuration of a first embodiment of the compatible hinge 1.

Figure 2:
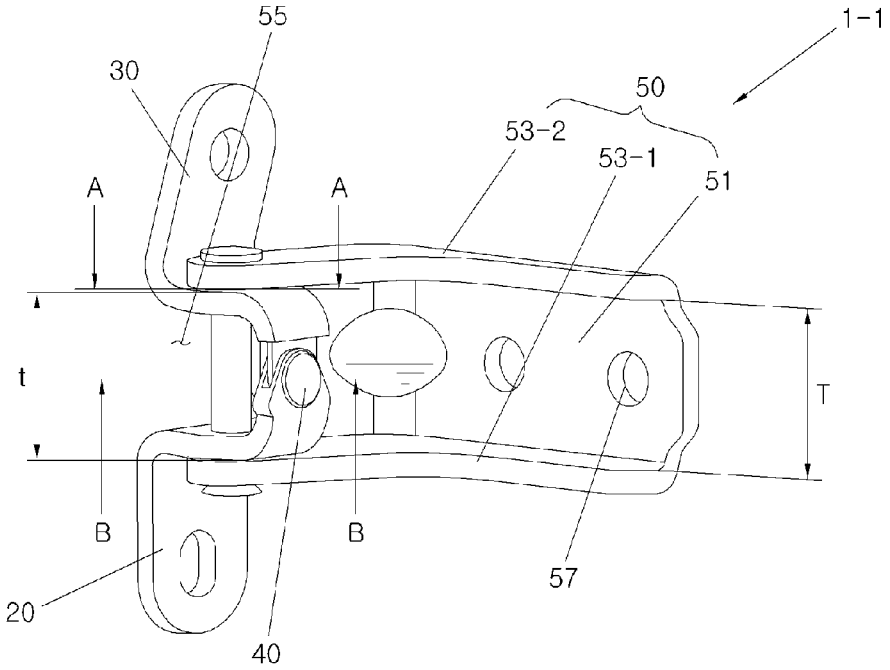
FIGS. 2 to 4 are views showing the configuration of an assembled compatible door hinge according to a first embodiment of the present invention.
Figure 3:
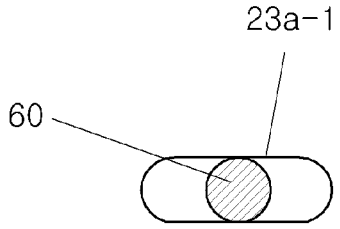
Figure 4:
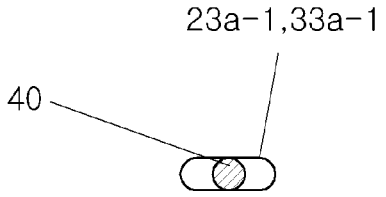
Figure 5:
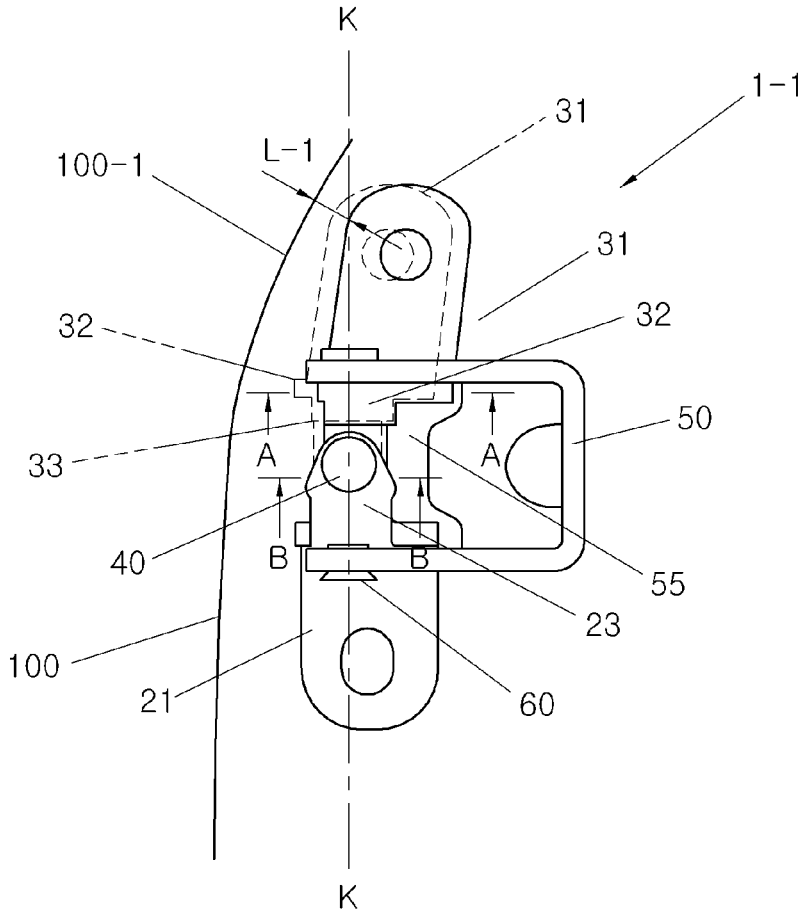
FIGS. 5 to 7 illustrate an example of setting the compatible door hinge according to the first embodiment of the present invention to correspond to the shape of a door skin.
Figure 6:
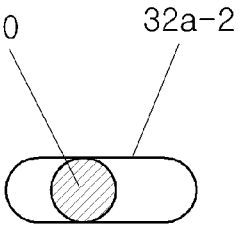

FIGS. 2-4 illustrate an example in which the compatible door hinge 1 is embodied as a first compatible door hinge 1-1. The first compatible hinge 1-1 includes an embodiment of a separable side plate unit 20, 30 and 40 using a linearly movable structure of the upper plate 30.

The first compatible door hinge 1-1 includes a lower plate 20, an upper plate 30, a hinge pin 40, a body plate 50 and a bushing pin 60. The elements of the first compatible door hinge 1-1 are the same as those of the compatible door hinge 1 described in FIG. 1. Also, the assembly process of the first compatible door hinge 1-1 including inserting the separable side plate unit 20, 30 and 40 having an insert width t into the body plate 50 having an assembly width T, and coupling the separable side plate unit 20, 30 and 40 to the body plate 50 using the bushing pin 60 is the same as that of the compatible door hinge 1 described in FIG. 1.

The only difference between the first compatible door hinge 1-1 and the compatible door hinge 1 is that an elongated pin hole 23*a*-1 is formed in the lower plate 20 of the first compatible door hinge 1-1 and an elongated pin hole 33*a*-1 is formed in the upper plate 30 thereof, unlike the compatible door hinge 1 having the pin hole 23*a* of the lower plate 20 and the pin hole 33*a* of the upper plate 30. In other words, each of the elongated pin holes 23*a*-1 and 33*a*-1 of the first compatible door hinge 1-1 has a slot shape, unlike the circular pin holes 23*a* and 33*a* of the compatible door hinge 1. Further, in the case of the first compatible door hinge 1-1, an elongated hinge hole 32*a*-1 is formed in the upper plate 30, unlike the compatible door hinge 1 in which the hinge hole 32*a* is formed in the upper plate 30. That is, the elongated hinge hole 32*a*-1 of the first compatible door hinge 1-1 has a slot shape, unlike the circular hinge hole 32*a* of the compatible door hinge 1. Therefore, in the first compatible door hinge 1-1, when the lower plate 20 and the upper plate 30 are assembled and integrated with each other by the hinge pin 40, the upper plate 30 is movable forward and rearward relative to the hinge pin 40 through the elongated pin holes 23*a*-1 and 33*a*-1 and is also movable in the insert opening 55 of the body plate 50 forward and rearward relative to the bushing pin 60 through the elongated hinge hole 32*a*-1. As a result, adjustment in horizontal orientation of the upper plate 30 to correspond to the pre-designed or preset shape of the door skin can be more facilitated.

Referring to FIGS. 3-7, it can be appreciated that the first compatible door hinge 1-1 can be adjusted in position to correspond to the design shape of an upper door skin 100-1 without changing a door opening/closing center line K-K.

For example, a worker disposes the first compatible door hinge 1-1 such that the bushing pin 60 is aligned with the door opening/closing center line K-K of the door skin 100 and then the lower plate 20 and the upper plate 30 are positioned at respective target installation portions. Subsequently, the worker checks whether a minimum required setting distance L-1 can be maintained between the upper plate 30 and the upper door skin 100-1. In the present embodiment, the minimum required setting distance L-1 is within about 12 mm.

If the upper plate 30 is disposed at a position designated by the dashed line, the minimum required setting distance L-1 between the upper plate 30 and the upper door skin 100-1 cannot be maintained. In this case, the worker pulls the upper plate 30 toward the body plate 50. Then, the upper plate 30 is moved away from the upper door skin 100-1 in such a way that the hinge pin 40 is disposed in a corresponding end of the elongated pin hole 33*a*-1 while the bushing pin 60 is disposed in a corresponding end of the elongated hinge hole 32*a*-1. Such movement of the upper plate 30 is performed until the minimum required setting distance L-1 between the upper plate 30 and the upper door skin 100-1 is maintained.

Therefore, even if the first compatible door hinge 1-1 is not designed to correspond to the design of the upper door skin 100-1 of the door skin 100, the minimum required setting distance L-1 between the upper plate 30 and the upper door skin 100-1 can be easily maintained by a change in position of the upper plate 30 by linearly moving the upper plate 30.

FIGS. 8-13 illustrate the detailed configuration of a second embodiment of the compatible hinge 1.

Figure 8:
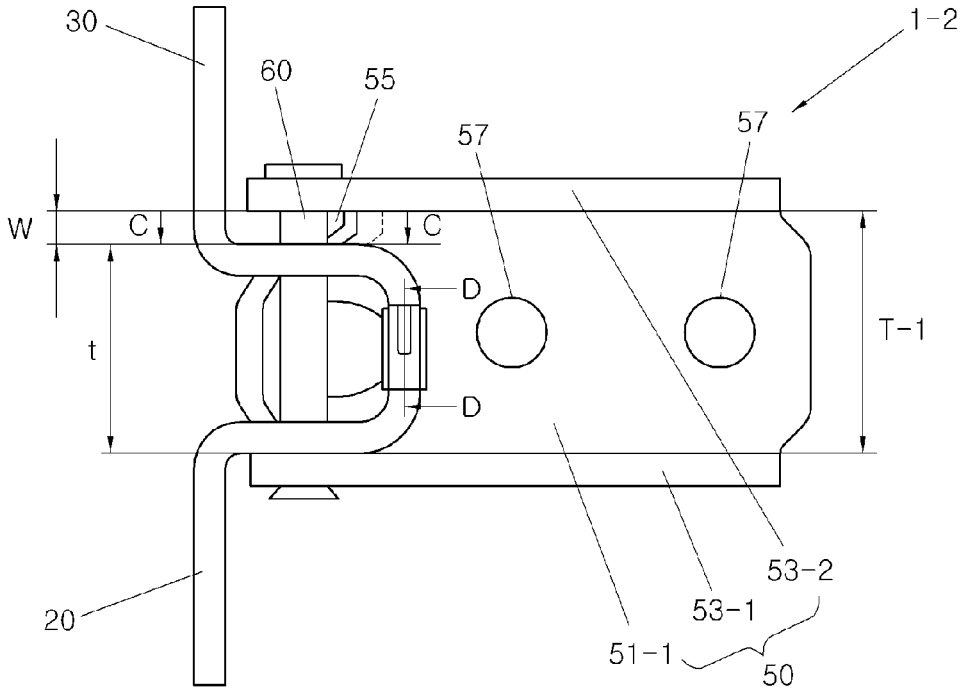
FIGS. 8 to 10 are views showing the configuration of an assembled compatible door hinge according to a second embodiment of the present invention.
Figure 9:
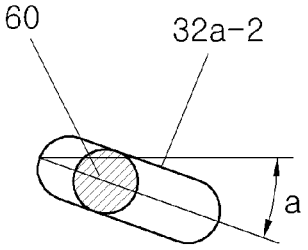
Figure 10:
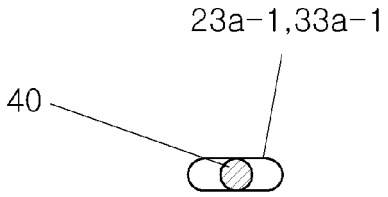

FIGS. 8-10 illustrate an example in which the compatible door hinge 1 is embodied as a second compatible door hinge 1-2. The second compatible hinge 1-2 includes an embodiment of a separable side plate unit 20, 30 and 40 using an angular movable structure of the upper plate 30.

The second compatible door hinge 1-2 includes a lower plate 20, an upper plate 30, a hinge pin 40, a body plate 50 and a bushing pin 60. The elements of the second compatible door hinge 1-2 are the same as those of the compatible door hinge 1 described in FIG. 1. Also, the assembly process of the second compatible door hinge 1-2 including inserting the separable side plate unit 20, 30 and 40 having an insert width t into the body plate 50 having an assembly width T-1, and coupling the separable side plate unit 20, 30 and 40 to the body plate 50 using the bushing pin 60 is the same as that of the compatible door hinge 1 described in FIG. 1.

The only difference between the second compatible door hinge 1-2 and the compatible door hinge 1 is that an elongated pin hole 23*a*-1 is formed in the lower plate 20 of the second compatible door hinge 1-2 and an elongated pin hole 33*a*-1 is formed in the upper plate 30 thereof, unlike the compatible door hinge 1 having the pin hole 23*a* of the lower plate 20 and the pin hole 33*a* of the upper plate 30. In other words, each of the elongated pin holes 23*a*-1 and 33*a*-1 of the second compatible door hinge 1-2 has a slot shape, unlike the circular pin holes 23*a* and 33*a* of the compatible door hinge 1. Here, each of the elongated pin holes 23*a*-1 and 33*a*-1 has a slot shape and may be inclined at a predetermined angle. Further, in the case of the second compatible door hinge 1-2, an inclined elongated hinge hole 32*a*-2 is formed in the upper plate 30, unlike the compatible door hinge 1 in which the hinge hole 32*a* is formed in the upper plate 30. That is, the inclined elongated hinge hole 32*a*-2 of the second compatible door hinge 1-2 has a slot shape and is inclined at a predetermined inclination angle a, unlike the circular hinge hole 32*a* of the compatible door hinge 2. In addition, the second compatible door hinge 1-2 differs from the compatible door hinge 1 in that an assembly width T-1 of a width-increased bent body 51-1 of the body plate 50 is greater than the assembly width T of the bent body 51 of the body plate 50 of the compatible door hinge 1. In other words, the assembly width T-1 of the second compatible door hinge 1-2 is greater than the assembly width T of the compatible door hinge 1 by a movement clearance W. Thus, the degree of freedom in movement of the upper plate 30 of the second compatible door hinge 1-2 is higher than that of the compatible door hinge 1 having the assembly width T without a movement clearance W. Therefore, in the second compatible door hinge 1-2, when the lower plate 20 and the upper plate 30 are assembled and integrated with each other by the hinge pin 40, the upper plate 30 is movable forward and rearward relative to the hinge pin 40 through the elongated pin holes 23*a*-1 and 33*a*-2 and is also rotatable in the insert opening 55 of the body plate 50 forward and rearward relative to the bushing pin 60 through the inclined elongated hinge hole 32*a*-2 and the movement clearance W that is defined by a difference between the inert width t and the assembly width T-1. As a result, horizontal adjustment in orientation of the upper plate 30 to correspond to the pre-designed or preset shape of the door skin can be more facilitated.

Figure 11:
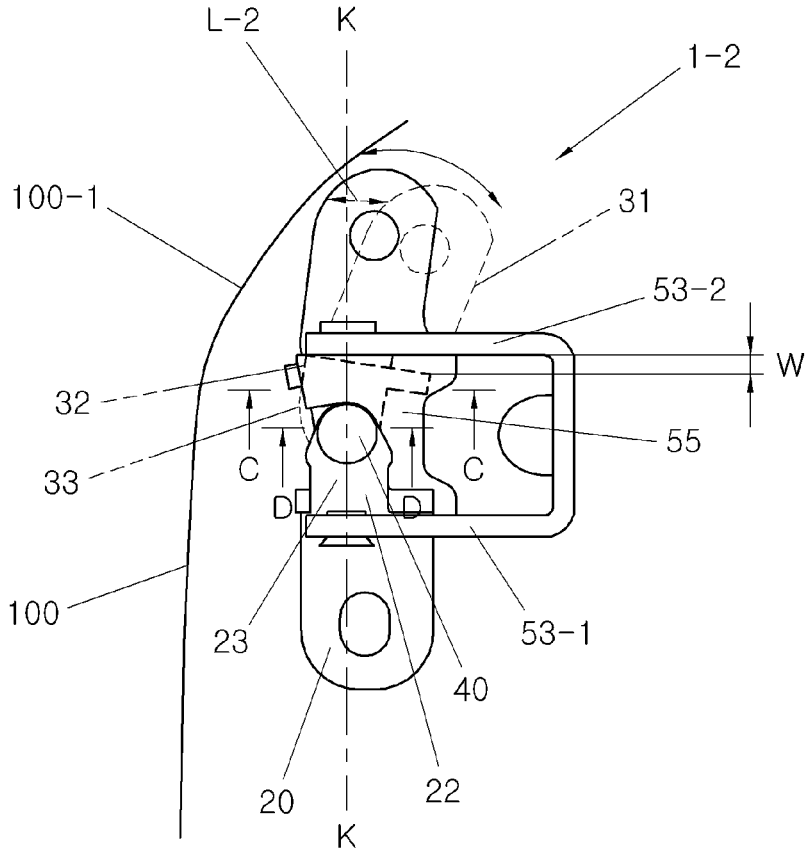
FIGS. 11 to 13 illustrate an example of setting the compatible door hinge according to the second embodiment of the present invention to correspond to the shape of a door skin.
Figure 12:
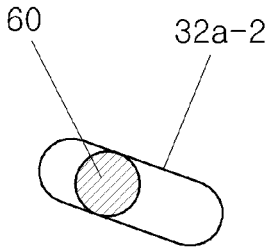
Figure 13:
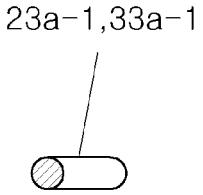

Referring to FIGS. 11-13, it can be appreciated that the second compatible door hinge 1-2 can be adjusted in position to correspond to the design shape of an upper door skin 100-1 without changing a door opening/closing center line K-K.

For example, a worker disposes the second compatible door hinge 1-2 such that the bushing pin 60 is aligned with the door opening/closing center line K-K of the door skin 100 and then the lower plate 20 and the upper plate 30 are positioned at respective target installation portions. Subsequently, the worker checks whether a minimum required setting distance L-2 can be maintained between the upper plate 30 and the upper door skin 100-1. In the present embodiment, the minimum required setting distance L-2 is within about 12 mm.

If the upper plate 30 is disposed at a position designated by the solid line, the minimum setting distance L-2 between the upper plate 30 and the upper door skin 100-1 cannot be maintained. In this case, the worker rotates the upper plate 30 toward the body plate 50. Then, the upper plate 30 is moved away from the upper door skin 100-1 in such a way that the hinge pin 40 is disposed in a corresponding end of the elongated pin hole 33*a*-1 while the bushing pin 60 is disposed in a corresponding end of the inclined elongated hinge hole 32*a*-2. Here, the inclination angle a of the inclined elongated hinge hole 32*a*-2 of the upper plate 30 and the movement clearance W of the width-increased bent body 51-1 of the body plate 50 function to make it possible for the upper plate 30 to rotate using the hinge pin 40 as the center of rotation. Such angular movement of the upper plate 30 is performed until the minimum required setting distance L-2 between the upper plate 30 and the upper door skin 100-1 is maintained.

Therefore, even if the second compatible door hinge 1-2 is not designed to correspond to the design of the upper door skin 100-1 of the door skin 100, the minimum required setting distance L-2 between the upper plate 30 and the upper door skin 100-1 can be easily maintained by a change in position of the upper plate 30 resulting from the angular movement of the upper plate 30.

Figure 14:
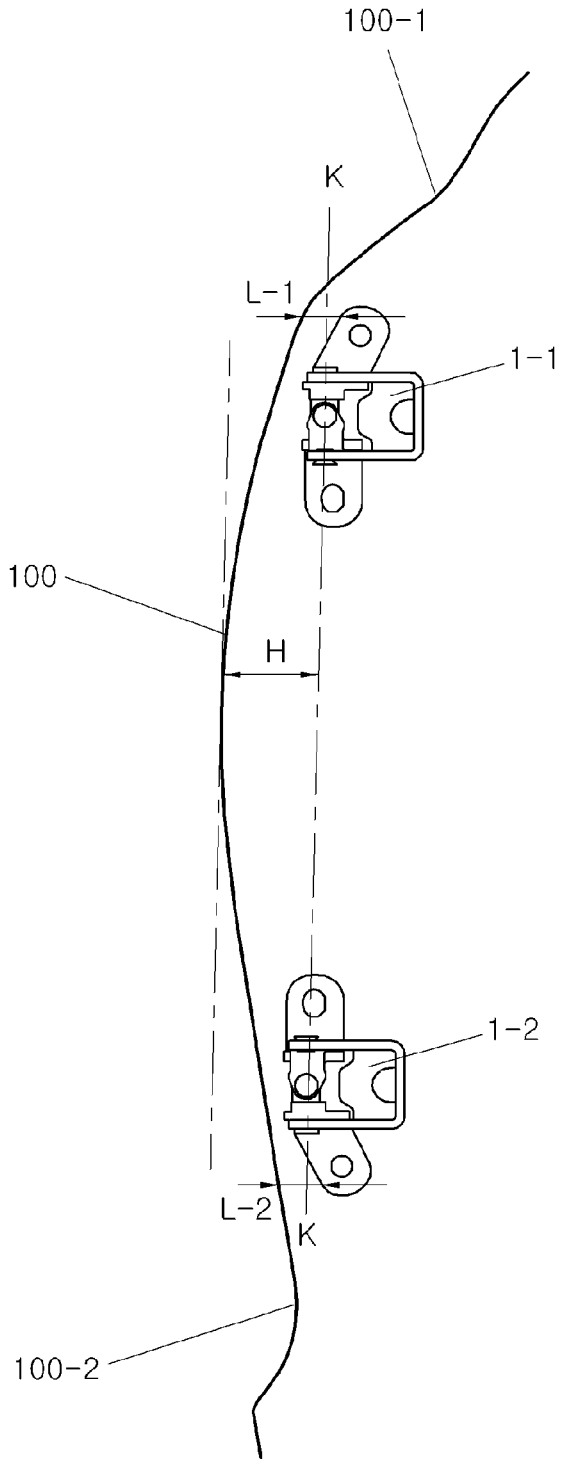
FIG. 14 illustrates conditions in which the compatible door hinges according to the first and second embodiments of the present invention are set to correspond to the shape of a door skin.

FIG. 14 illustrates an example in which the first and second compatible door hinges 1-1 and 1-2 are used as the compatible door hinges 1 applied to the door skin 100.

As shown in FIG. 14, the compatible door hinges 1 include the first compatible door hinge 1-1 that is applied to the upper door skin 100-1 of the door skin 100, and the second compatible door hinge 1-2 that is applied to a lower door skin 100-2 of the door skin 100. Alternatively, the first compatible door hinges 1 may include two first compatible door hinges 1-1 or two second compatible door hinges 1-2 which are applied to the respective upper and lower door skins 100-1 and 100-2.

The first compatible door hinge 1-1 applied to the upper door skin 100-1 can easily ensure the minimum required setting distance L-1 with respect to the upper door skin 100-1 by linearly moving the upper plate 30 and thus changing the position thereof. The second compatible door hinge 1-2 applied to the lower door skin 100-2 can easily ensure the minimum required setting distance L-2 with respect to the upper door skin 100-1 by rotating the upper plate 30 and thus changing the position thereof. Particularly, the linear movement and angular movement of the upper plates 30 make it possible for the door opening/closing center line K-K to be disposed as close to the door skin 100 as possible so that a hinge distance H can be shortest, whereby a rotation gap of the door when opening can be effectively ensured.

Figure 15:
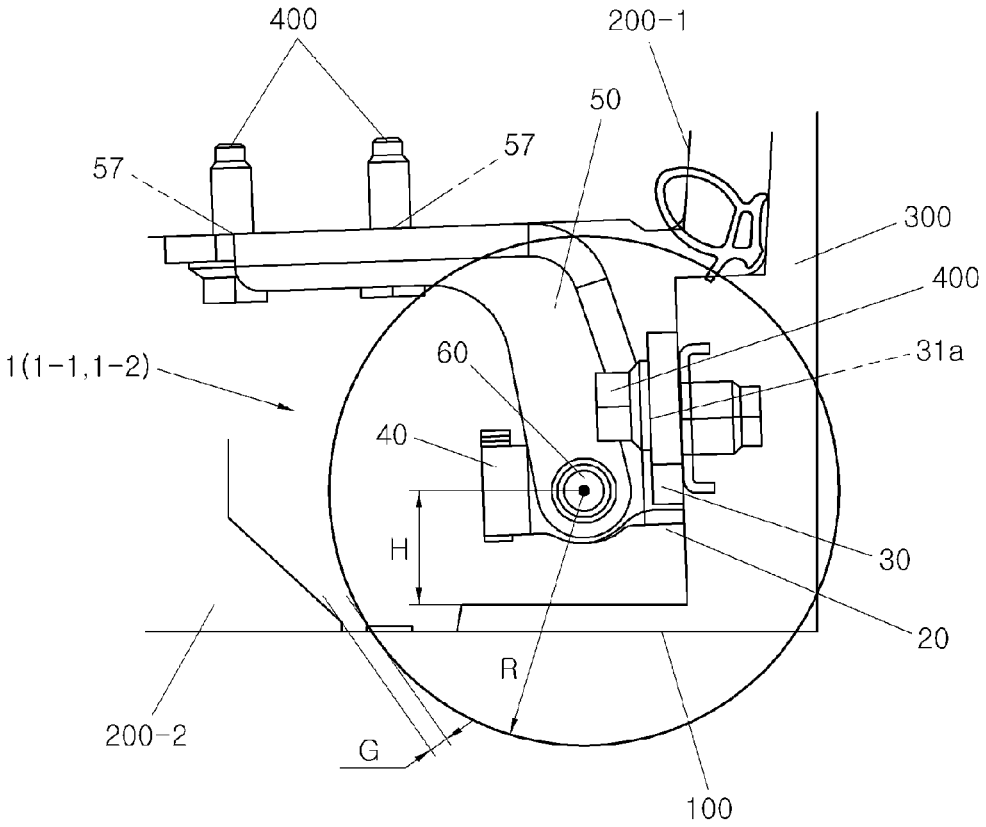
FIG. 15 is a view showing a door opening trajectory reduced in radius by application of the compatible door hinge according to the first or second embodiment of the present invention.

FIG. 15 illustrates an example of the door 300 in which the first compatible door hinge 1-1 or the second compatible door 1-2 is used as the compatible door hinge 1. In the following description, the first compatible door hinge 1-1 or the second compatible door hinge 1-2 will be represented as the compatible door hinge 1.

As shown in FIG. 15, the lower plate 20 and the upper plate 30 of the compatible door hinge 1 that have been integrated with each other by the hinge pin 40 are coupled to the door skin 100 by bolts 400 and thus integrated with the vehicle door 300. The body plate 50 of the compatible door hinge 1 that has been integrated with the upper and upper plates 20 and 30 by the bushing pin 60 is coupled to the vehicle body panel 200-1 by bolts 400 and thus integrated with the vehicle body.

Therefore, when the door 300 rotates using the bushing pin 60 as the center of rotation and opens, a turning radius R of the door 300 can be increased or reduced corresponding to the hinge distance H. As described with reference to FIG. 6, the door opening/closing center line K-K of the compatible door hinge 1 is formed as close to the door skin 100 as possible so that the hinge distance H can be reduced. Thus, the turning radius R of the vehicle door 500 is reduced by a reduced length of the hinge distance H, whereby the rotation gap G, which is a space required between the vehicle door 300 and a pillar 200-2 when the vehicle door 300 opens, can be easily ensured.

Therefore, the compatible door hinge 1 makes it possible to enhance the degree of freedom in design of the door skin 100 and improve the fitting of the vehicle door 300. Further, the rotation gap G required for opening the vehicle door can be easily ensured.

As described above, the compatible door hinge according to an embodiment of the present invention includes: the lower plate 20 which has the pin hole 23*a* and the hinge hole 22*a* in which the hinge pin 40 and the bushing pin 60 are respectively disposed; the upper plate 30 which is coupled to the lower plate 20 by the hinge pin 40 and can be changed in position relative to the lower plate 20; and the body plate 50 with which the lower plate 20 and the upper plate 30 are integrated by the bushing pin 60 passing through them. The minimum required setting distance between the door hinge and the upper door skin 100-1 or the lower door skin 100-2 of the vehicle door 300 can be easily maintained without changing the design shape of the door skin. Particularly, the door opening trajectory can be formed closer to the door skin 100 and reduced in radius, whereby the rotation gap can be more easily ensured.

A compatible door hinge according to the present invention has a pin assembly type structure in which two separate side plates are assembled with each other by a pin. Therefore, the position at which the two side plates are fixed to a vehicle door can be adjusted to correspond to a pre-designed shape of a door skin. Therefore, the degree of freedom in design of the door skin with regard to the structure of the side plates can be increased.

Further, in the compatible door hinge according to the present invention, because the pin assembly type side plates are used, the hinge shaft can be disposed closer to the door skin, thus making it possible to ensure a rotation gap for reducing a radius of a door opening trajectory.

In addition, in the compatible door hinge according to the present invention, the upper side plate can be rotated relative to the lower side plate to correspond to the pre-designed shape of the door skin. Thereby, the hinge shaft can be variably set, whereby the compatibility of the door hinge can be further enhanced.

While the present invention has been described with respect to the specific embodiments, it will be apparent to those skilled in the art that various changes and modifications may be made without departing from the spirit and scope of the invention as defined in the following claims

What is claimed is:

1. A compatible door hinge for vehicles, comprising:

a lower plate having a pin hole in which a hinge pin is disposed, and a hinge hole in which a bushing pin is disposed;

an upper plate having a pin hole in which the hinge pin is disposed so that the upper plate is coupled to the lower plate by the hinge pin, and a hinge hole in which the bushing pin is disposed such that the upper plate can be changed in position relative to the lower plate;

a body plate having an assembly width and allowing coupling portions of the lower and upper plates to be inserted thereinto, the coupling portions being coupled to each other by the hinge pin and having an insert width, the body plate having hinge holes in which the bushing pin is disposed such that the lower plate and the upper plate are integrated with the body plate, wherein the coupling portions coupled to each other by the hinge pin have an insert coupling structure, and wherein the insert coupling structure is embodied by a depression shape formed in a bent body of the lower plate and a protrusion shape provided on a bent body of the upper plate.

2. The compatible door hinge of claim 1, wherein the lower plate comprises: the bent body in which the pin hole and the hinge hole are formed, each of the pin hole and the hinge hole having a circular shape; a position fixing body perpendicularly bent from the bent body, with a bolt hole formed in the position fixing body; and a female boss extending from the bent body and forming the coupling portion to be coupled with the protrusion shape provided on the upper plate, the coupling portion of the female boss having the pin hole and the depression shape formed in the lower plate as an insert slot through which the protrusion shape provided on the upper plate is coupled to the coupling portion of the female boss, and the upper plate comprises: the bent body in which the pin hole and the hinge hole are formed, each of the pin hole and the hinge hole having a circular shape; an inclined position-fixing body perpendicularly bent from the bent body, with a bolt hole formed in the inclined position-fixing body; and a male boss extending from the bent body and having the pin hole therein, the male boss forming the protrusion shape provided on the upper plate as the coupling portion to be inserted into the insert slot and coupled with the lower plate.

3. The compatible door hinge of claim 2, wherein the inclined position-fixing body is inclined in one direction with respect to the bent body.

4. The compatible door hinge of claim 1, wherein the lower plate comprises: the bent body in which the pin hole and the hinge hole are formed, the pin hole being an elongated hole while the hinge hole has a circular shape; a position fixing body perpendicularly bent from the bent body, with a bolt hole formed in the position fixing body; and a female boss extending from the bent body and forming the coupling portion to be coupled with the protrusion shape provided on the upper plate, the coupling portion of the female boss having the pin hole and the depression shape formed in the lower plate as an insert slot through which the protrusion shape provided on the upper plate is coupled to the coupling portion of the female boss, and the upper plate comprises: the bent body in which the pin hole and the hinge hole are formed, each of the pin hole and the hinge hole being an elongated hole; an inclined position-fixing body perpendicularly bent from the bent body, with a bolt hole formed in the inclined position-fixing body; and a male boss extending from the bent body and having the pin hole therein, the male boss forming the protrusion shape provided on the upper plate as the coupling portion to be inserted into the insert slot and coupled with the lower plate.

5. The compatible door hinge of claim 4, wherein the elongated holes allow the change in relative position of the upper plate to be performed in a linear section.

6. The compatible door hinge of claim 4, wherein the inclined position-fixing body is inclined in one direction with respect to the bent body.

7. The compatible door hinge of claim 1, wherein the assembly width of the body plate is greater than the insert width.

8. The compatible door hinge of claim 7, wherein the body plate comprises: the bent body which is bent at a right angle; and an insert opening formed in a portion of the bent body and receiving the coupling portions coupled to each other by the hinge pin, wherein the insert opening provides a space for allowing the change in position of the upper plate relative to the lower plate.

9. The compatible door hinge of claim 8, wherein the bent body comprises upper and lower side extension parts extending along an entire length of the bent body and perpendicularly bent from the bent body, the upper and lower side extension parts forming the assembly width therebetween.

10. The compatible door hinge of claim 1, wherein the lower plate comprises: the bent body in which the pin hole and the hinge hole are formed, the pin hole being an elongated hole while the hinge hole has a circular shape; a position fixing body perpendicularly bent from the bent body, with a bolt hole formed in the position fixing body; and a female boss extending from the bent body and forming the coupling portion to be coupled with the protrusion shape provided on the upper plate, the coupling portion of the female boss having the pin hole and the depression shape formed in the lower plate as an insert slot through which the protrusion shape provided on the upper plate is coupled to the coupling portion of the female boss, and the upper plate comprises: the bent body in which the pin hole and the hinge hole are formed, the pin hole being an elongated hole while the hinge hole is an inclined elongated hole; a position-fixing body perpendicularly bent from the bent body, with a bolt hole formed in the position-fixing body; and a male boss extending from the bent body and having the pin hole therein, the male boss forming the protrusion shape provided on the upper plate as the coupling portion to be inserted into the insert slot and coupled with the lower plate, wherein the assembly width of the body plate is an assembly width increased by a movement clearance.

11. The compatible door hinge of claim 10, wherein the elongated hole allows the change in relative position of the upper plate to be embodied by angular motion.

12. The compatible door hinge of claim 10, wherein each of the pin hole of the lower plate and the pin hole of the upper plate is an inclined elongated hole.

13. The compatible door hinge of claim 10, wherein the inclined position-fixing body is inclined in one direction with respect to the bent body.

* * * * *